US010844582B1

(12) United States Patent
Hocaoglu et al.

(10) Patent No.: US 10,844,582 B1
(45) Date of Patent: Nov. 24, 2020

(54) FARMHOUSE SINK SYSTEM WITH A RIMLESS STAINLESS STEEL SINK

(71) Applicants: Mehmet Hocaoglu, Ft. Lauderdale, FL (US); Yavuz Hocaoglu, Miami, FL (US)

(72) Inventors: Mehmet Hocaoglu, Ft. Lauderdale, FL (US); Yavuz Hocaoglu, Miami, FL (US)

( * ) Notice: Subject to any disclaimer, the term of this patent is extended or adjusted under 35 U.S.C. 154(b) by 44 days.

(21) Appl. No.: 16/243,669

(22) Filed: Jan. 9, 2019

Related U.S. Application Data

(60) Provisional application No. 62/615,131, filed on Jan. 9, 2018.

(51) Int. Cl.
*E03C 1/182* (2006.01)

(52) U.S. Cl.
CPC ..... *E03C 1/182* (2013.01)

(58) Field of Classification Search
CPC ..... E03C 1/182
USPC ..... 4/630
See application file for complete search history.

(56) References Cited

U.S. PATENT DOCUMENTS

| | | | | |
|---|---|---|---|---|
| 2,080,573 | A | 5/1937 | Madsen | |
| 2,476,215 | A | 7/1949 | Patton | |
| 2,495,853 | A | 1/1950 | Lindgren | |
| 4,175,292 | A | 11/1979 | Morrison | |
| 4,374,695 | A | 2/1983 | Ikeda et al. | |
| 5,016,297 | A | 5/1991 | Sauter et al. | |
| 5,551,103 | A | 9/1996 | Drozdowich et al. | |
| 5,754,991 | A | 5/1998 | Drozdowich et al. | |
| 5,997,009 | A | 12/1999 | Geise | |
| 6,349,429 | B1 | 2/2002 | Zurba et al. | |
| 6,571,406 | B2 | 6/2003 | Gerloff | |
| D494,665 | S * | 8/2004 | Herbeau | D23/293.1 |
| 6,986,174 | B2 | 1/2006 | Brown | |
| 7,007,317 | B1 | 3/2006 | Brown | |
| 7,216,461 | B1 | 5/2007 | Clemmer | |
| 7,263,811 | B1 | 9/2007 | Clemmer | |
| 7,278,176 | B2 | 10/2007 | Clarke | |
| D624,635 | S * | 9/2010 | Eckhaus | D23/308 |
| D627,449 | S * | 11/2010 | Eckhaus | D23/308 |

(Continued)

FOREIGN PATENT DOCUMENTS

| | | |
|---|---|---|
| BR | 102015020203 | 2/2016 |
| CA | 2707848 | 6/2004 |

(Continued)

*Primary Examiner* — Lori L Baker
(74) *Attorney, Agent, or Firm* — Malloy & Malloy, P.L.

(57) ABSTRACT

A farmhouse sink system with a rimless stainless steel sink comprises a cabinet assembly having a countertop mounted thereon. A farmhouse sink frame has a sink mounting aperture dimensioned to receive a rimless upper edge of the sink therein, such that the rimless upper edge of the stainless steel sink is coplanar with the top of the frame. A mounting assembly is attached to a portion of the stainless steel sink and is utilized to attach the stainless steel sink to a portion of the farmhouse sink frame. An upper interface is formed between the rimless upper edge of the stainless steel sink and the top surface of the farmhouse sink frame, and an upper seal is disposed therein. The farmhouse sink frame is mounted between the cabinet assembly and the countertop such that the stainless steel sink is operatively disposed below a sink access opening through the countertop.

20 Claims, 10 Drawing Sheets

(56) References Cited

U.S. PATENT DOCUMENTS

| | | | | |
|---|---|---|---|---|
| 8,418,281 | B2 | 4/2013 | Sutter | |
| 8,844,070 | B2 * | 9/2014 | Booth | E03C 1/33 4/631 |
| 9,173,487 | B2 * | 11/2015 | Booth | E03C 1/18 |
| 9,492,010 | B2 * | 11/2016 | Booth | E03C 1/18 |
| 9,492,011 | B2 * | 11/2016 | Booth | E03C 1/18 |
| 9,689,152 | B2 | 6/2017 | Hocaoglu | |
| 9,803,347 | B2 | 10/2017 | Hocaoglu | |
| 9,995,026 | B2 * | 6/2018 | Booth | E03C 1/33 |
| 10,092,097 | B2 * | 10/2018 | Booth | E03C 1/18 |
| 10,098,455 | B2 * | 10/2018 | Booth | E03C 1/18 |
| 10,104,962 | B2 * | 10/2018 | Booth | E03C 1/335 |
| 10,125,481 | B2 * | 11/2018 | Booth | E03C 1/18 |
| 10,130,172 | B2 * | 11/2018 | Booth | E03C 1/18 |
| 10,130,173 | B2 * | 11/2018 | Booth | E03C 1/18 |
| 10,151,085 | B2 * | 12/2018 | Chong | E03C 1/18 |
| 10,221,552 | B2 | 3/2019 | Hocaoglu | |
| 10,226,122 | B2 * | 3/2019 | Booth | E03C 1/18 |
| D845,451 | S * | 4/2019 | Swilley | D23/308 |
| 10,370,835 | B2 | 8/2019 | Hocaoglu et al. | |
| D858,722 | S * | 9/2019 | Bucher | D23/284 |
| 10,422,115 | B2 * | 9/2019 | Chong | E03C 1/33 |
| D865,138 | S * | 10/2019 | Lyons | D23/293.1 |
| D871,562 | S * | 12/2019 | Parekh | D23/290 |
| 10,501,919 | B2 * | 12/2019 | Chong | E03C 1/18 |
| 2008/0178381 | A1 | 7/2008 | Montgomery et al. | |
| 2009/0144893 | A1 | 6/2009 | Cusimano | |
| 2010/0017956 | A1 | 1/2010 | Chen | |
| 2012/0222211 | A1 * | 9/2012 | Booth | E03C 1/186 4/619 |
| 2012/0222212 | A1 * | 9/2012 | Booth | E03C 1/18 4/619 |
| 2012/0222213 | A1 * | 9/2012 | Booth | A47B 77/06 4/648 |
| 2012/0306165 | A1 | 12/2012 | Sutter | |
| 2014/0250589 | A1 | 9/2014 | Sgarlata et al. | |
| 2015/0000031 | A1 * | 1/2015 | Booth | E03C 1/18 4/619 |
| 2015/0059082 | A1 | 3/2015 | Hocaoglu | |
| 2015/0059083 | A1 | 3/2015 | Hocaoglu | |
| 2015/0059084 | A1 | 3/2015 | Hocaoglu | |
| 2015/0354188 | A1 | 12/2015 | Hocaoglu | |
| 2016/0040406 | A1 * | 2/2016 | Booth | E03C 1/33 4/619 |
| 2017/0037606 | A1 * | 2/2017 | Booth | A47B 77/06 |
| 2017/0058497 | A1 * | 3/2017 | Booth | A47B 77/06 |
| 2017/0138028 | A1 * | 5/2017 | Booth | A47B 77/06 |
| 2017/0138029 | A1 * | 5/2017 | Booth | A47B 77/022 |
| 2017/0138030 | A1 * | 5/2017 | Booth | A47B 77/06 |
| 2017/0138031 | A1 * | 5/2017 | Booth | E03C 1/33 |
| 2017/0138032 | A1 * | 5/2017 | Booth | A47B 77/06 |
| 2018/0186655 | A1 * | 7/2018 | Cobb | C02F 1/008 |
| 2018/0187400 | A1 * | 7/2018 | Chong | E03C 1/18 |
| 2018/0187403 | A1 * | 7/2018 | Chong | A47B 77/06 |
| 2018/0258624 | A1 * | 9/2018 | Booth | A47B 77/06 |
| 2019/0191874 | A1 * | 6/2019 | Booth | A47B 77/06 |
| 2020/0102726 | A1 * | 4/2020 | Miller | E03C 1/33 |
| 2020/0102727 | A1 * | 4/2020 | Li | E03C 1/182 |

FOREIGN PATENT DOCUMENTS

| | | |
|---|---|---|
| CA | 2506806 | 10/2006 |
| CA | 2839586 | 1/2014 |
| CN | 2600497 | 1/2004 |
| CN | 2837401 | 11/2006 |
| CN | 104452917 | 3/2015 |
| DE | 10254052 | 7/2004 |
| EP | 1422352 | 5/2004 |
| EP | 2884013 | 3/2014 |
| FR | 2757031 | 6/1998 |
| FR | 2792345 | 10/2000 |
| WO | WO2009073873 | 6/2009 |

* cited by examiner

FARMHOUSE SINK SYSTEM WITH A RIMLESS STAINLESS STEEL SINK

BACKGROUND OF THE INVENTION

Field of the Invention

The present invention is directed to a farmhouse style sink system incorporating a rimless stainless steel sink to provide a seamless interface between a stainless steel sink and a farmhouse sink frame, resulting in an overall aesthetically improved appearance. The incorporation of a stainless steel sink also results in a farmhouse sink system which is significantly more durable and hygienic as compared to traditional farmhouse sink systems.

Description of the Related Art

Farmhouse sink systems include a farmhouse sink frame having a sink basin incorporated therein, wherein the farmhouse sink frame is typically mounted below a countertop, flush with the top of an underlying cabinet or cabinets, thereby providing the unique "farmhouse" look and feel. Traditionally, farmhouse sink systems are formed from any number of materials of construction including, but not limited to, fireclay, cast iron, porcelain, quartz, granite or marble, just to name a few. As is well known in the art, over time, the materials typically used to construct farmhouse sink systems are susceptible to chipping, cracking, etc. Furthermore, a number of these materials are notorious for being difficult to thoroughly clean due to the somewhat irregular surface condition on the inside of the farmhouse sink basin.

In a typical installation of a farmhouse sink system, an opening is created in a cabinet or cabinets which is dimensioned to receive a farmhouse sink frame therein. The supporting framework is secured to portions of the cabinet or cabinets adjacent to the opening created to receive the farmhouse sink frame. The supporting framework is positioned such that the top surface of the farmhouse sink frame is in line and level with the top surface of the cabinet or cabinets. It is also typical for a farmhouse sink frame to include an apron which extends outwardly from the front face of the cabinet or cabinets.

Next, and access opening corresponding generally to the dimensions of the farmhouse sink basin is created through a portion of a countertop. Silicone sealant is applied between the interface along the lower surface of the countertop and the top surface of the farmhouse sink frame. The silicone sealant is typically fully cured in about 24 hours, after which time a faucet, drain, and any other plumbing appurtenances are installed to the farmhouse sink frame, and a typical farmhouse sink system is ready for use.

As noted above, the materials typically used to construct farmhouse sink systems are susceptible to chipping, cracking, etc., and a number of these materials are difficult to thoroughly clean due to the somewhat irregular surface condition on the inside of the farmhouse sink basin.

As such, it would be highly beneficial to provide a farmhouse sink system which combines the highly desired aesthetic appeal of the "farmhouse" sink style with a stainless steel sink basin for substantially improved durability and hygiene. A further advantage may be realized by providing an improved farmhouse sink system having a farmhouse sink frame which is constructed of a lightweight material such as an acrylic or other engineered plastic. It would also be extremely beneficial to provide a system to retrofit an existing farmhouse sink system with a rimless stainless steel sink basin to overlie and conceal a damaged original farmhouse sink basin, thereby substantially improving durability and hygiene of the existing farmhouse sink system. It would also be advantageous to provide a new farmhouse sink system having typical materials of construction, such as, but not limited to, fireclay, cast iron, porcelain, quartz, granite or marble, which further comprises a rimless stainless steel sink basin, once again, to substantially improve durability and hygiene of the new farmhouse sink system.

SUMMARY OF THE INVENTION

The present invention is directed to a farmhouse sink system with a rimless stainless steel sink. The present system comprises a cabinet assembly having one or more cabinets, and a countertop having an upper surface and a lower surface being mounted on the cabinet assembly. A sink access opening is disposed through a portion of the countertop, an in at least one embodiment, the sink access opening comprises a U-shaped configuration.

The present system further comprises a farmhouse sink frame which is dimensioned to be mounted between the cabinet assembly and the countertop, wherein the farmhouse sink frame has a top surface and an interior bottom surface, and a sink mounting aperture formed between the top surface and the interior bottom surface.

The present system further comprises a stainless steel sink having a sidewall which partially forms at least one bowl. In at least one embodiment, a rimless upper edge along and around said sidewall of said stainless steel sink, wherein an outer periphery is defined around said rimless upper edge. In one further embodiment, the rimless upper edge of the stainless steel sink is disposed adjacent and substantially coplanar with the top surface of the farmhouse sink frame when the stainless steel sink is mounted into the sink mounting aperture of the farmhouse sink frame through the interior bottom surface.

A mounting assembly is provide in one embodiment comprising at least one mounting bracket attached to a portion of the stainless steel sink. More in particular, the at least one mounting bracket is utilized to attach the stainless steel sink to a portion of the farmhouse sink frame, in at least one embodiment, to an interior bottom surface thereof.

When a stainless steel sink is attached to a portion of a farmhouse sink frame in an operative disposition, an upper interface is formed between the rimless upper edge of the stainless steel sink and the top surface of the farmhouse sink frame. In at least one embodiment, an upper seal is disposed in the upper interface between the rimless upper edge of the stainless steel sink and the top surface of the farmhouse sink frame, wherein the upper seal serves to prevent water, moisture, bacteria, food, and/or other debris such as may be encountered in a sink environment from entering into the area between the farmhouse sink frame and the stainless steel sink, in particular, into and through the upper interface there between.

In accordance with at least eon embodiment of the present system, the farmhouse sink frame is mounted between the cabinet assembly and the countertop such that the stainless steel sink is operatively disposed adjacent and below a sink access opening through the countertop.

The present invention is also directed to a method for the installation of a farmhouse sink system with a rimless stainless steel sink. The method, in at least eon embodiment, comprises fabricating a stainless steel sink with a rimless upper edge defining an outer periphery there around; creating a sink mounting aperture through a farmhouse sink frame between a top surface and an interior bottom surface, wherein the sink mounting aperture comprises an inner periphery dimensioned to receive the outer periphery of the rimless upper edge of the stainless steel sink therein; positioning at least one mounting bracket at a predetermined mounting depth below the rimless upper edge of the stainless steel sink; attaching the at least one mounting bracket to the stainless steel sink; inserting the rimless upper edge of the stainless steel sink through the interior bottom surface of the farmhouse sink frame and into the sink mounting aperture, such that the rimless upper edge of the stainless steel sink is adjacent and substantially coplanar with the top surface of the farmhouse sink frame; securing the stainless steel sink to the interior bottom surface of the farmhouse sink frame via at least one mounting bracket; and, applying an upper seal along an upper interface between the rimless upper edge of the stainless steel sink and the inner periphery of the sink mounting aperture through the farmhouse sink frame, wherein the upper seal prevents water, moisture, bacteria, and debris from entering between the rimless upper edge of the stainless steel sink and the farmhouse sink frame.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

Figure 1:
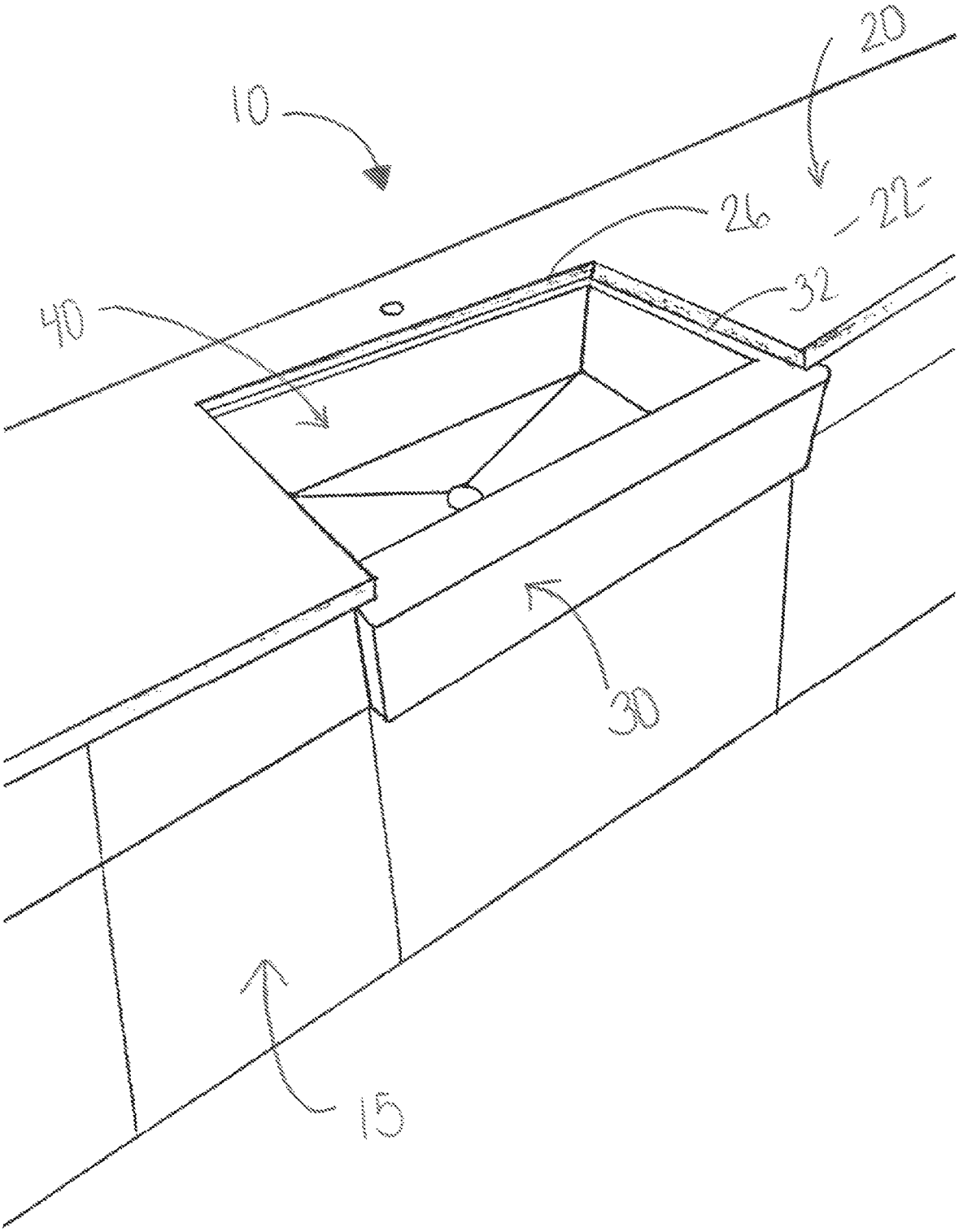
FIG. 1 is a perspective view of one illustrative embodiment of a farmhouse sink system with a rimless stainless steel sink in accordance with the present invention.

The present invention is directed to a farmhouse sink system with a rimless stainless steel sink generally as shown as at 10 throughout the figures. With reference to the illustrative embodiment of FIG. 1, a farmhouse sink system with a stainless steel sink 10 includes a cabinet assembly 15 and a countertop 20. As further shown in the illustrative embodiment of FIG. 1, a farmhouse sink system with the stainless steel sink 10 further includes a farmhouse sink frame 30 having a stainless steel sink 40 seamlessly installed therein. With continued reference to the illustrative embodiment of FIG. 1, the farmhouse sink frame 30 is operatively disposed between the cabinet assembly 15 and a sink access opening 26 through the countertop 20 and below an upper surface 22 thereof, in accordance with known installation methods as discussed above with regard to the related art.

Figure 2:
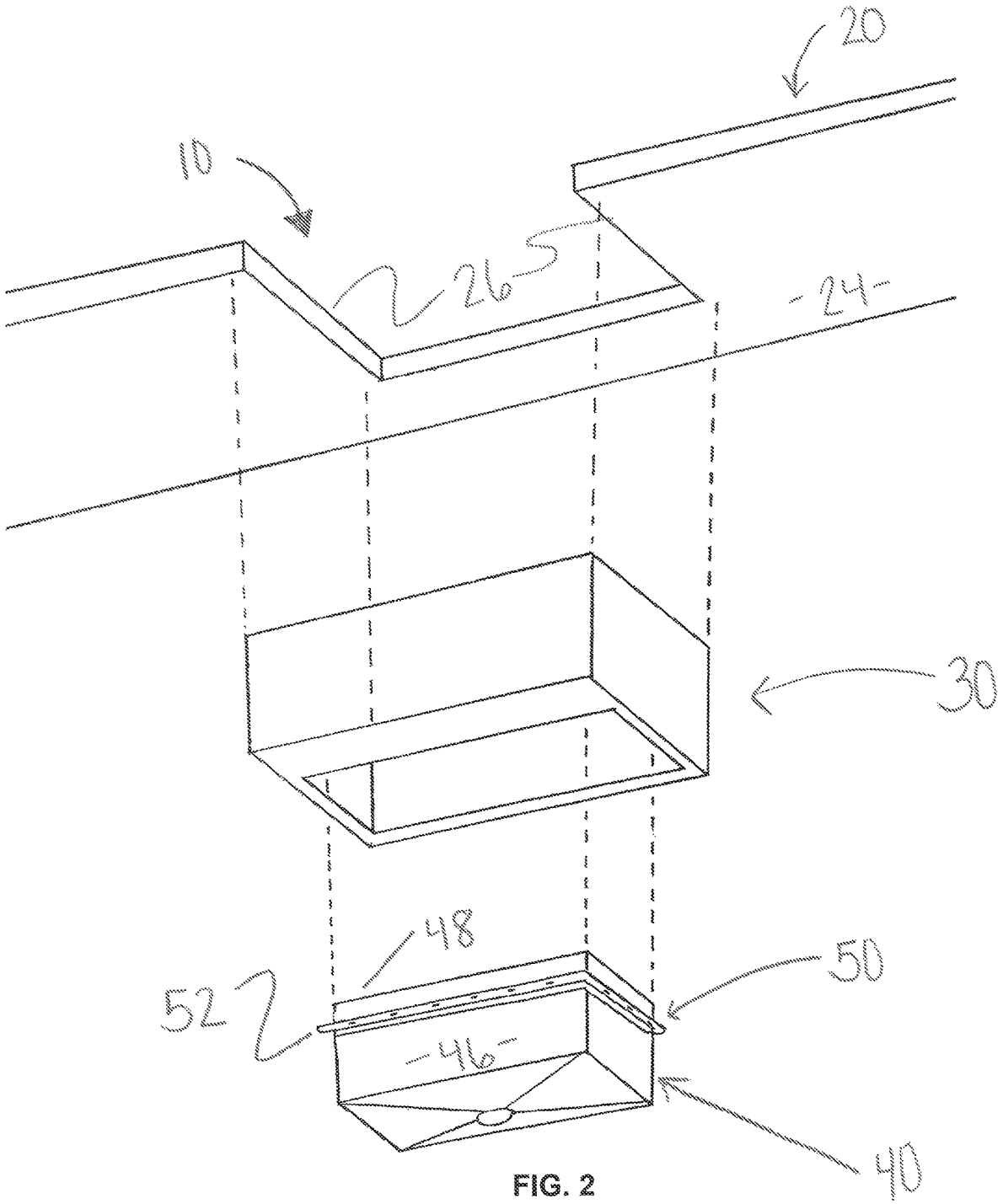
FIG. 2 is a partial exploded perspective view of another illustrative embodiment of a farmhouse sink system with a rimless stainless steel sink in accordance with the present invention.

FIG. 2 is an exploded perspective view of another illustrative embodiment of a farmhouse sink system with the stainless steel sink 10 in accordance with the present invention. As may be seen from FIG. 2, countertop 20 has a sink access opening 26 formed there through. In at least one embodiment, a sink access opening 26 comprises a generally U-shaped configuration. As will be appreciated by those of skill in the art, a sink access opening 26 may be dimensioned so as to align with an outer periphery 49 of a bowl 42 of a stainless steel sink 40. Alternatively, a sink access opening 26 may be dimensioned slightly larger than an outer periphery 49 of a bowl 42 of a stainless steel sink 40 such that a portion of a top surface 32 of a farmhouse sink frame 30 is exposed and forms a lip or ledge around the outer periphery 49 of the bowl 42 of the stainless steel sink 40, such as is shown in the illustrative embodiment of FIG. 1.

Looking once again to the illustrative embodiment of FIG. 2, the farmhouse sink system with a rimless stainless steel sink 10 further comprises a farmhouse sink frame 30. As shown in the exploded perspective view of FIG. 2, the farmhouse sink frame 30 is affixed to a lower surface 24 of the countertop 20 proximate to a sink access opening 26. As will be appreciated by those of skill in the art, a farmhouse sink frame 30 in accordance with the present invention may be formed from any number of materials of construction including, but not limited to, fireclay, cast iron, porcelain, quartz, granite or marble, just to name a few. In at least one embodiment, a farmhouse sink frame 30 in accordance with the present invention is formed of acrylic. The interface between the lower surface 22 of the countertop 20 and the top surface 32 of the farmhouse sink frame 30 may be sealed with any appropriate water resistant sealant such as, by way of example only, silicone.

As further shown in the illustrative embodiment of FIG. 2, a stainless steel sink 40 is under mounted into a farmhouse sink frame 30. A mounting assembly 50 comprising at least one mounting bracket 52 is affixed to the sidewall 46 of the stainless steel sink 40 below a rimless upper edge 48 thereof. The at least one mounting bracket 52 is utilized to under mount the stainless steel sink 40 to the farmhouse sink frame 30.

Figure 3A:
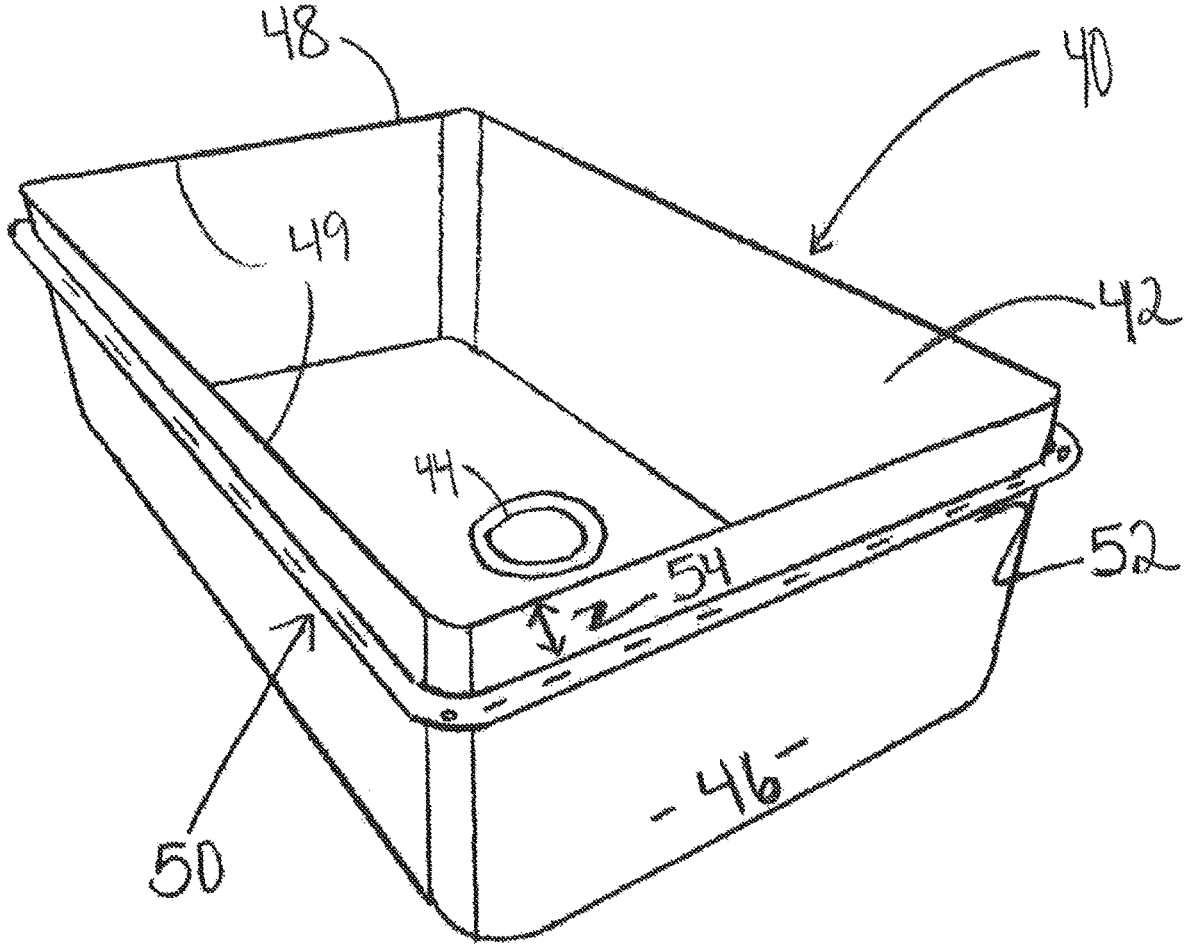
FIG. 3A is a perspective view of one illustrative embodiment of a stainless steel sink in accordance with the present invention.
Figure 3B:
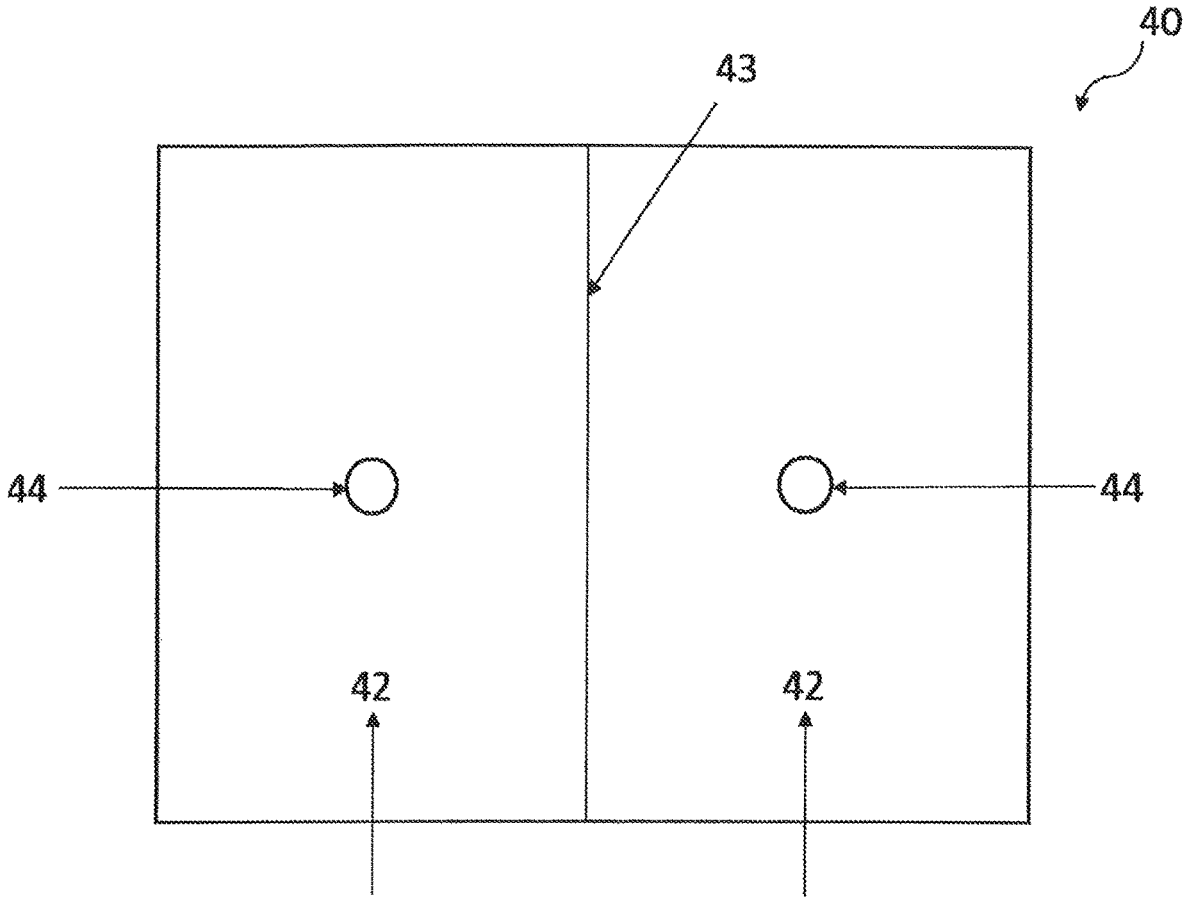
FIG. 3B is a top view of one illustrative embodiment of a stainless steel sink in accordance with the present invention.

Turning next to FIG. 3A, a perspective view of one illustrative embodiment of a stainless steel sink 40 in accordance with the present invention is shown. A stainless steel sink 40 includes at least one bowl 42 having a drain 44 disposed through a lower surface thereof. As will be appreciated by those of skill in the art, and as illustrated in FIG.

3B, a stainless steel sink 40 could comprise a plurality of bowls 42 separated from one another via a recessed divider 43, each bowl 42 having a corresponding drain 44. Looking further to the illustrative embodiment of FIG. 3A, the stainless steel sink 40 comprises a sidewall 46 at least partially defining the configuration of the bowl 42. The sidewall 46 of the stainless steel sink 40 has a rimless upper edge 48 disposed there around, the rimless upper edge 48 defining an outer periphery 49 of the stainless steel sink 40.

With continued reference to the illustrative embodiment of FIG. 3A, a mounting assembly 50 is affixed to a portion of the stainless steel sink 40 to facilitate mounting the stainless steel sink 40 into the farmhouse sink frame 30, as described in further detail below. A mounting assembly 50 in accordance with the present invention comprises at least one mounting bracket 52 affixed to a portion of the sidewall 46 of the stainless steel sink 40. As shown in the illustrative embodiment of FIG. 3A, the mounting assembly 50 comprises a single continuous mounting bracket 52 extending around the entire sidewall 46 of the stainless steel sink 40. As will be appreciated by those of skill in the art, a plurality of mounting brackets 52 independent of one another may be affixed to different portions of the sidewall 46 of the stainless steel sink 40, in lieu of the single continuous mounting bracket 52 as shown throughout the figures.

As further shown in the illustrative embodiment of FIG. 3A, a mounting bracket 52 is affixed to the sidewall 46 of the stainless steel sink 40 at a predetermined mounting depth 54 below the rimless upper edge 48 of the stainless steel sink 40. More in particular, a predetermined mounting depth 54 shall be equal to the thickness of a sink mounting aperture 36 formed between a top surface 32 and an interior bottom surface 34 of a farmhouse sink frame 30 as discussed in further detail below. In at least one embodiment, a predetermined mounting depth 54 has a tolerance of between 0.0 and −1.0 millimeters.

Figure 4:
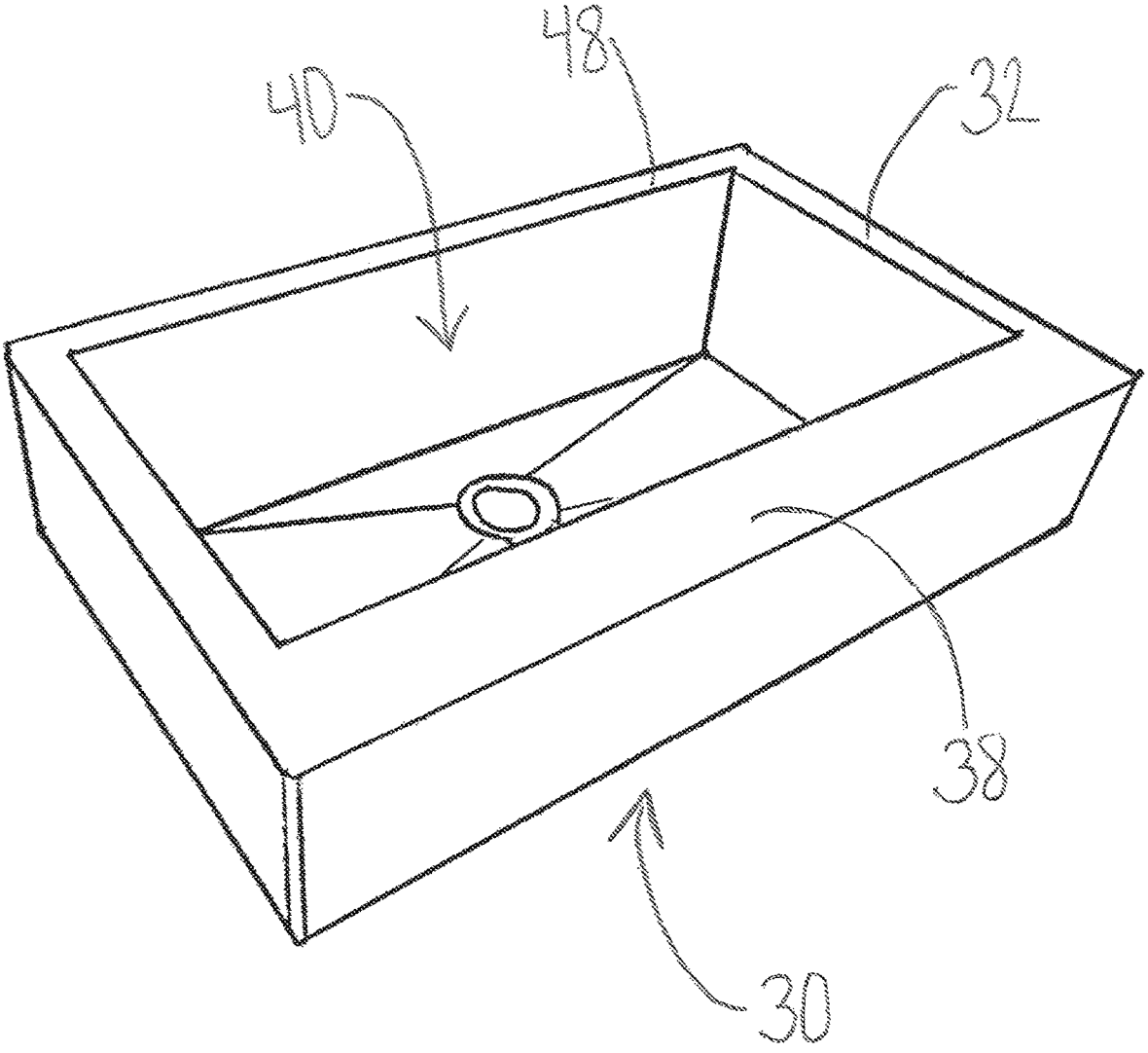
FIG. 4 is a top perspective view of one illustrative embodiment of a stainless steel sink seamlessly mounted in a farmhouse sink frame in accordance with the present invention.

Turning next to FIGS. 4 through 7, one illustrative embodiment of a farmhouse sink frame 30 having a stainless steel sink 40 seamlessly installed therein is presented. More in particular, FIG. 4 is illustrative of one embodiment of a stainless steel sink 40 seamlessly installed in a farmhouse sink frame 30. As may be seen from FIGS. 4 and 7, a rimless upper edge 48 of the stainless steel sink 40 is essentially coplanar with a top surface 32 of the farmhouse sink frame 30. FIG. 4 further illustrates a farmhouse sink frame 30 having an apron 38 extending outwardly from the stainless steel sink 40 along the front of the farmhouse sink frame 30.

Figure 5:
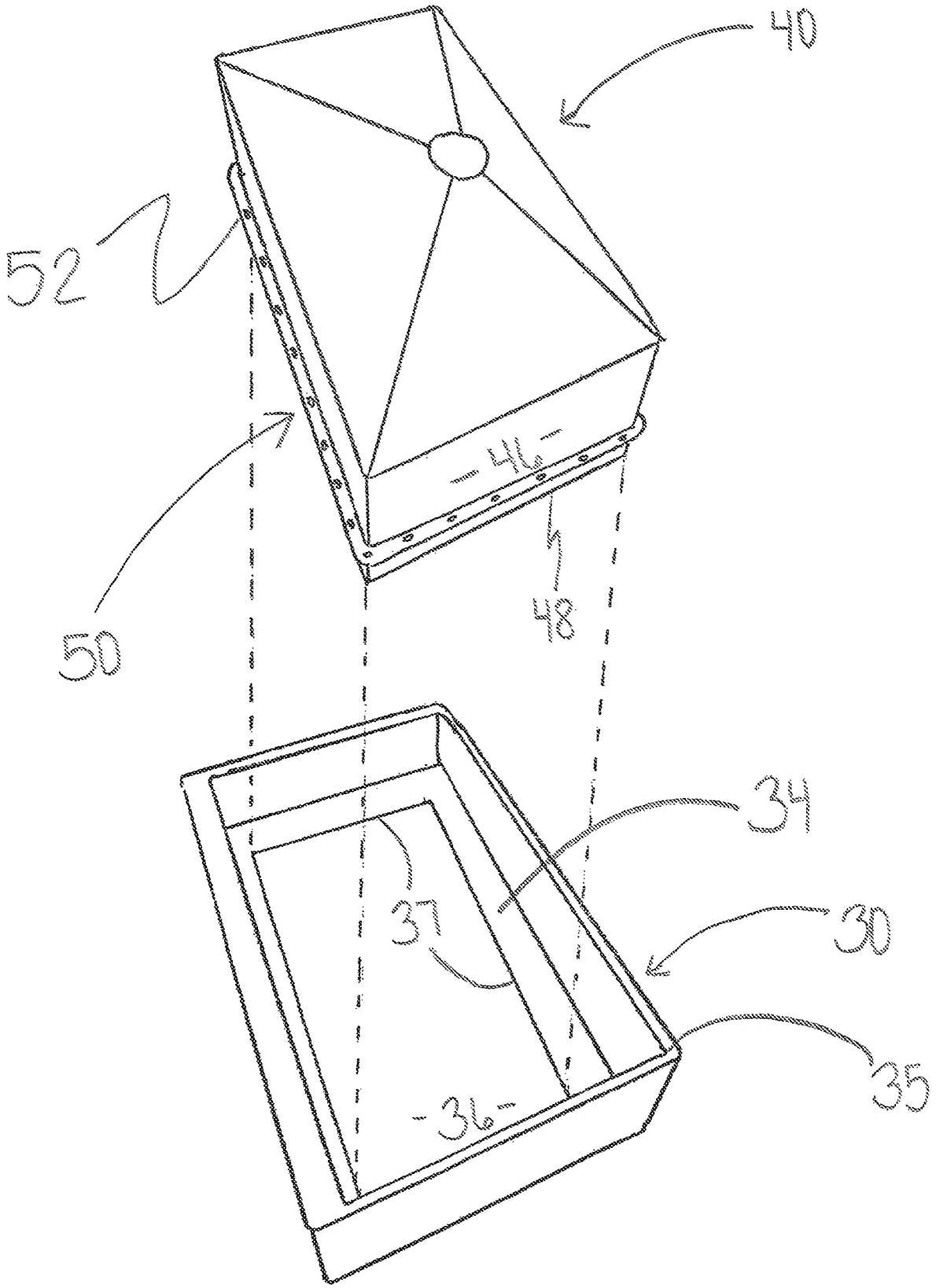
FIG. 5 is an exploded bottom perspective view of the stainless steel sink and the farmhouse sink frame of FIG. 4.
Figure 6:
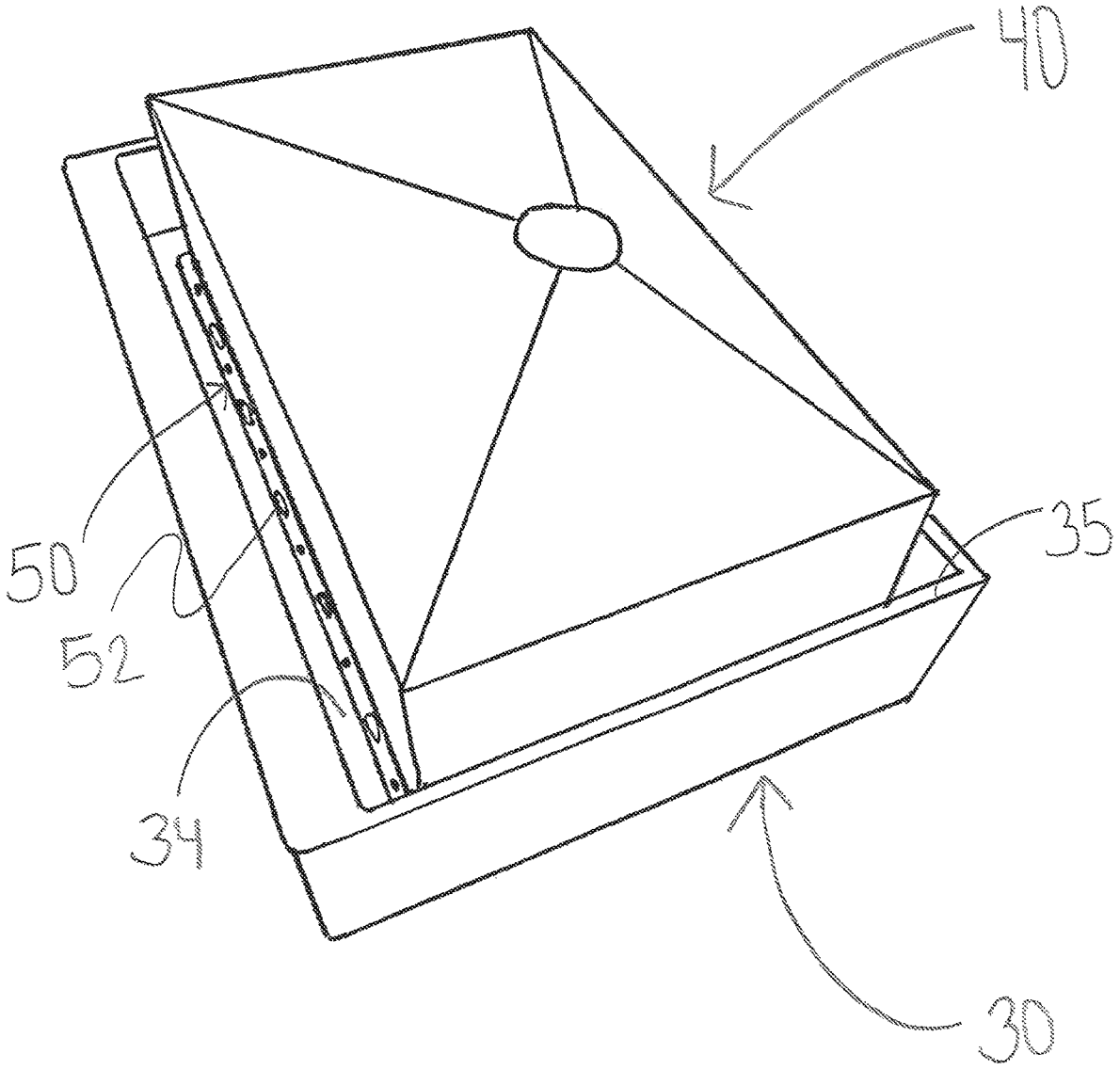
FIG. 6 is a bottom perspective view of the stainless steel sink mounted in the farmhouse sink frame of FIG. 5.

FIG. 5 is an exploded bottom perspective view of a stainless steel sink 40 and a farmhouse sink frame 30 in accordance with at least one embodiment of the present invention. As an initial matter, as may be seen from the illustrative embodiment of FIG. 5, a farmhouse sink frame 30 in accordance with at least one embodiment of the present invention comprises a recessed interior bottom surface 34 and an exterior bottom surface 35. A sink mounting aperture 36 is formed through the interior bottom surface 34 of the farmhouse sink frame 30. More in particular, a sink mounting aperture 36 comprises an inner periphery 37 which is dimensioned to correspond to the outer periphery 49 along the rimless upper edge 48 of the sidewall 46 of the stainless steel sink 40. In at least one embodiment, the tolerance between an inner periphery 37 of a sink mounting aperture 36 of a farmhouse sink frame 30 and an outer periphery 49 along a rimless upper edge 48 of the stainless steel sink 40 is less than 1.0 millimeter.

As further illustrated in FIG. 5, a mounting assembly 50 comprises a continuous mounting bracket 52 is affixed around and encircling the entire sidewall 46 of the stainless steel sink 40. Turning next to the illustrative embodiment of FIG. 6, the mounting bracket 52 abuts against the interior bottom surface 34 of the farmhouse sink frame 30.

Figure 7:
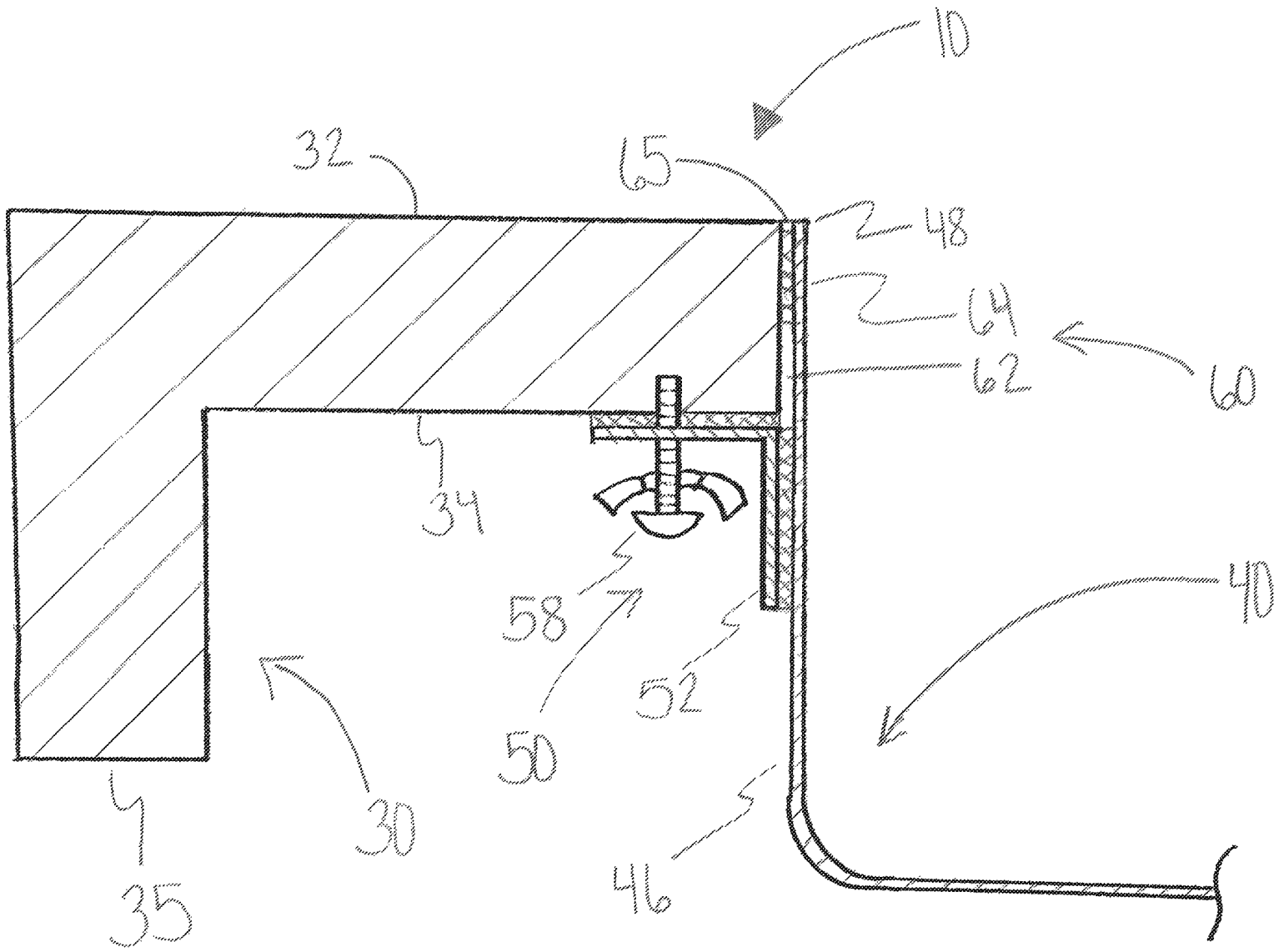
FIG. 7 is a partial cross-sectional view of one illustrative embodiment of a stainless steel sink mounted in a farmhouse sink frame in accordance with the present invention.

FIG. 7 is a partial cross-sectional view of one illustrative embodiment of a stainless steel sink 40 mounted in a farmhouse sink frame 30 in accordance with the present invention. As may be seen from FIG. 7, a portion of a mounting assembly 50, i.e., a mounting bracket 52, is securely attached to a portion of a sidewall 46 of a stainless steel sink 40. It will be appreciated by those of skill in the art that a mounting bracket 52 may be securely attached to a sidewall 46 of a stainless steel sink 40 by any of a variety of means including but not limited to welding, adhesives, such as, by way of example only, an acrylic resin, an epoxy resin or a polyester resin, or via mechanical fasteners such as screws, bolts, rivets, etc. It will further be appreciated that a combination of means may be employed in order to further assure that a mounting bracket 52 is securely attached along and around a sidewall 46 of a stainless steel sink 40. As will be further appreciated by those of skill in the art, a mounting bracket 52 may be securely attached to a sidewall 46 of a stainless steel sink 40 prior to delivery to an installation site, however, alternatively, one or more mounting bracket 52 may be securely attached to a sidewall 46 of a stainless steel sink 40 at the installation site during installation of the present farmhouse sink system with a rimless stainless steel sink 10.

With further reference to the illustrative embodiment of FIG. 7, a portion of a mounting bracket 52 is securely attached to a portion of the interior bottom surface 34 of the farmhouse sink frame 30. As before, any of a variety of appropriate attachment means may be utilized to securely attach a portion of a mounting bracket 52 to the interior bottom surface 34 of the farmhouse sink frame 30, such as an adhesive including, by way of example only, an acrylic resin, an epoxy resin or a two-part epoxy resin. In such an embodiment, the adhesive is permitted to flow through the apertures through the mounting bracket 52 and onto the underside of a portion of the mounting bracket 52 to further facilitate securely attaching the mounting bracket 52 to the interior bottom surface 34 of the farmhouse sink frame 30. In at least one other embodiment, a mechanical fastener 58, such as a screw or bolt, is utilized in order to securely attach a portion of a mounting bracket 52 to the interior bottom surface 34 of the farmhouse sink frame 30. IN at least one embodiment, a mounting clip (not shown) may be utilized in combination with a mechanical fastener 58. As will be appreciated by those of skill in the art, a combination of an adhesive and a mechanical fastener 58 may be utilized in order to further assure that a mounting bracket 52 is securely attached to the interior bottom surface 34 of the farmhouse sink frame 30.

Looking again to the illustrative embodiment of FIG. 7, a farmhouse sink system with a rimless stainless steel sink 10 in accordance with the present invention further comprises a sealing assembly 60. The sealing assembly 60 includes an upper seal 64 which is applied along and around the upper interface 62 between the inner periphery 37 of sink mounting aperture 36 of the farmhouse sink frame 30 and the outer periphery 49 around and along the rimless upper edge 48 of the sidewall 46 of the stainless steel sink 40. In one embodiment, the upper seal 64 comprises an adhesive, such as, by way of example only, an acrylic resin, an epoxy resin or an epoxy glue which is securely bonded to both the farmhouse sink frame 30 and the stainless steel sink 40, thereby providing an essentially impervious seal over and along the upper interface 62. In an alternate embodiment, the upper seal 64 comprises a polyester resin to securely bond to both the farmhouse sink frame 30 and the stainless steel sink 40, once again, providing an essentially impervious seal over and along the upper interface 62. In further embodiments, the upper seal 64 comprises an adhesive such as, by way of example, an acrylic casting resin, a polyester resin, a polyurethane resin, an epoxy resin or an epoxy glue, or combinations thereof. As will be appreciated, the upper seal 64 will serve to prevent water, moisture, bacteria, food, and/or other debris such as may be encountered in a sink environment from entering into the area between the farmhouse sink frame 30 and the stainless steel sink 40, in particular, into and through the upper interface 62 there between. In at least one embodiment, an upper seal 64 may be sanded or ground down as needed to remove any rough edges or overspills so as to assure a seamless interface between the inner periphery 37 of the sink mounting aperture 36 of the farmhouse sink frame 30 and the outer periphery 49 around and along the rimless upper edge 48 of the sidewall 46 of the stainless steel sink 40.

In at least one further embodiment, a top coat 65 is applied to the upper seal 64 wherein the top coat 65 is selected based on the color of the top surface 32 of the farmhouse sink frame 30 so as to camouflage the presence of the upper seal 64. The top coat 65, in at least one embodiment, comprises a color matching acrylic, epoxy or polyester resin selected to simulate the color of the top surface 32 of the farmhouse sink frame 30. In yet one further embodiment, the upper seal 64 and/or top coat 65 may be further finished by sanding, buffing, etc., so as to further camouflage the presence of the upper seal 64, thereby enhancing the overall seamless appearance between the stainless steel sink 30 and the farmhouse sink frame 30 along the upper seal 64, such as is shown best in FIG. 1.

Figure 8:
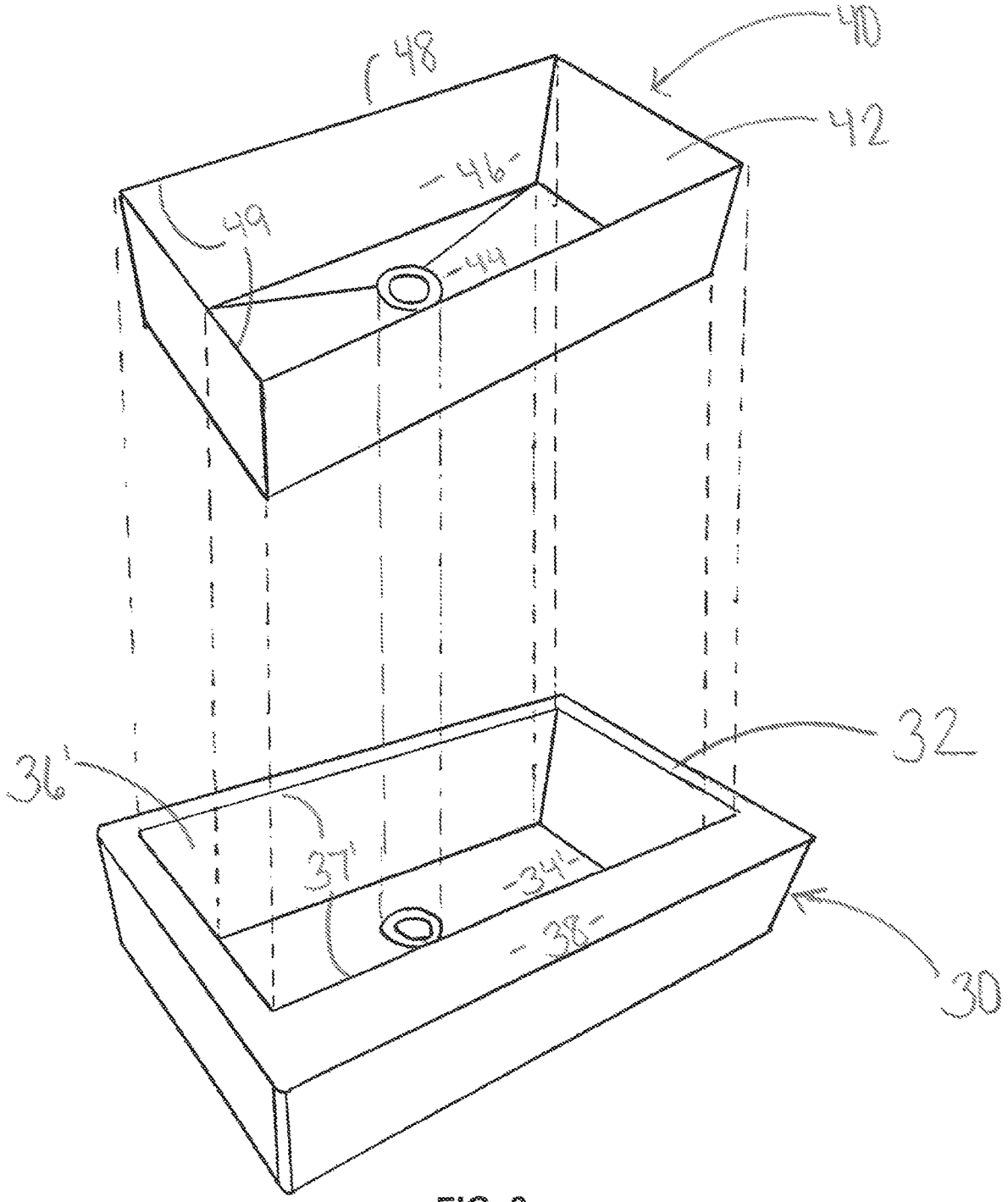
FIG. 8 is an exploded perspective view of one alternative illustrative embodiment of a farmhouse sink system with a rimless stainless steel sink in accordance with the present invention.

FIG. 8 is an exploded perspective view of one alternative illustrative embodiment of a farmhouse sink frame 30 with a rimless stainless steel sink 40 in accordance with the present invention. Unlike the illustrative embodiments of the present invention as shown in the preceding figures, the embodiment of FIG. 8 comprises a top mounted rimless stainless steel sink 40. As before, the stainless steel sink 40 comprises a sidewall 46 at least partially defining a bowl 42, wherein the bowl has a drain 44 disposed along a lower portion thereof. Also as before, the stainless steel sink 40 has a rimless upper edge 48 which at least partially defines an outer periphery 49 around the sidewall 46 of the stainless steel sink 40.

Turning next to the farmhouse sink frame 30 of the illustrative embodiment of FIG. 8, as before, the farmhouse sink frame 30 has a top surface 32 and, in at least one embodiment, an apron 38. The farmhouse sink frame 30 in accordance with the embodiment of FIG. 8 has a recessed interior bottom surface 34', however, unlike the prior embodiments of the present invention, the interior bottom surface 34' is accessible through the top of the farmhouse sink frame 30. Further, the sink mounting aperture 36' which is at least partially defined by inner periphery 37' is configured in the shape of a sink basin. As before, a farmhouse sink frame 30 may be constructed of any of a number of materials of constructions including, but not limited to, fireclay, cast iron, porcelain, quartz, granite or marble, just to name a few. In at least one embodiment, a farmhouse sink frame 30 is constructed of an acrylic or other engineered plastic material.

To effect installation, a bonding agent is applied to the interior bottom surface 34' and along the sidewalls of the farmhouse sink frame 30, and the stainless steel sink 40 is inserted through the sink mounting aperture 36' until the rimless upper edge 48 of the stainless steel sink 40 is substantially coplanar with the top surface 32 of the farmhouse sink frame 30. Any voids between the upper rimless edge 48 of the stainless steel sink 40 and the top surface 32 of the farmhouse sink frame 30 are filled in with boning agent. As before, after the bonding agent fully cures, sanding or grinding may be utilized to remove any rough edges or overspills, so as to assure a seamless interface between the upper rimless edge 48 of the stainless steel sink 40 and the top surface 32 of the farmhouse sink frame 30.

As will be appreciated by those of skill in the art, the top mounted rimless stainless steel sink 40 in accordance with the illustrative embodiment of FIG. 8 may be utilized to retrofit an existing farmhouse sink More in particular, in at least one embodiment, the farmhouse sink frame 30 in accordance with the alternative illustrative embodiment of FIG. 8 comprises a used farmhouse sink basin 30. As before, a farmhouse sink may be constructed of any of a number of materials of constructions including, but not limited to, fireclay, cast iron, porcelain, quartz, granite or marble, just to name a few. After years of use, the interior surfaces of a farmhouse sink shown signs of wear, sometimes even forming cracks and leaks. As such, the present invention may be utilized to revitalize and even repair an existing farmhouse sink via a top mounted rimless stainless steel sink 40 sized for insertion and secure installation into an existing farmhouse sink basin 30.

As noted above, the present invention further comprises a method for the installation of a farmhouse sink system having a stainless steel sink. More in particular, and with reference to the illustrative embodiment of FIG. 9, the present invention comprises a method the installation of a farmhouse sink system having a stainless steel sink, generally as shown as at 100.

In accordance with at least one embodiment of the present invention, the present method 100 comprises fabricating a stainless steel sink with a rimless upper edge 110, wherein the rimless upper edge defines an outer periphery there around. The present method 100 further comprises creating a sink mounting aperture through a farmhouse sink frame 120 between a top surface and an interior bottom surface, wherein the sink mounting aperture comprises an inner periphery dimensioned to receive an outer periphery of a rimless upper edge of a stainless steel sink therein.

With reference to the illustrative embodiment of FIG. 9, the present method 100 also comprises positioning at least one mounting bracket at a predetermined mounting depth 130 below the rimless upper edge of the stainless steel sink. In at least one embodiment of the present method 100, a mounting bracket comprises a continuous mounting bracket which completely encircles a sidewall of the stainless steel sink. In at least one further embodiment, the present method 100 comprises positioning a plurality of mounting brackets at a predetermined mounting depth 130 below the rimless upper edge of the stainless steel sink.

The present method 100 further includes securely attaching at least one mounting bracket to the sidewall of the stainless steel sink 140, wherein the at least one mounting bracket is positioned a predetermined mounting depth below the rimless upper edge of the stainless steel sink. In one further embodiment, the present method 100 comprises securely attaching a plurality of mounting brackets to the sidewall of the stainless steel sink 140, wherein each of the plurality of mounting brackets is positioned a predetermined mounting depth below the rimless upper edge of the stainless steel sink.

Figure 9:
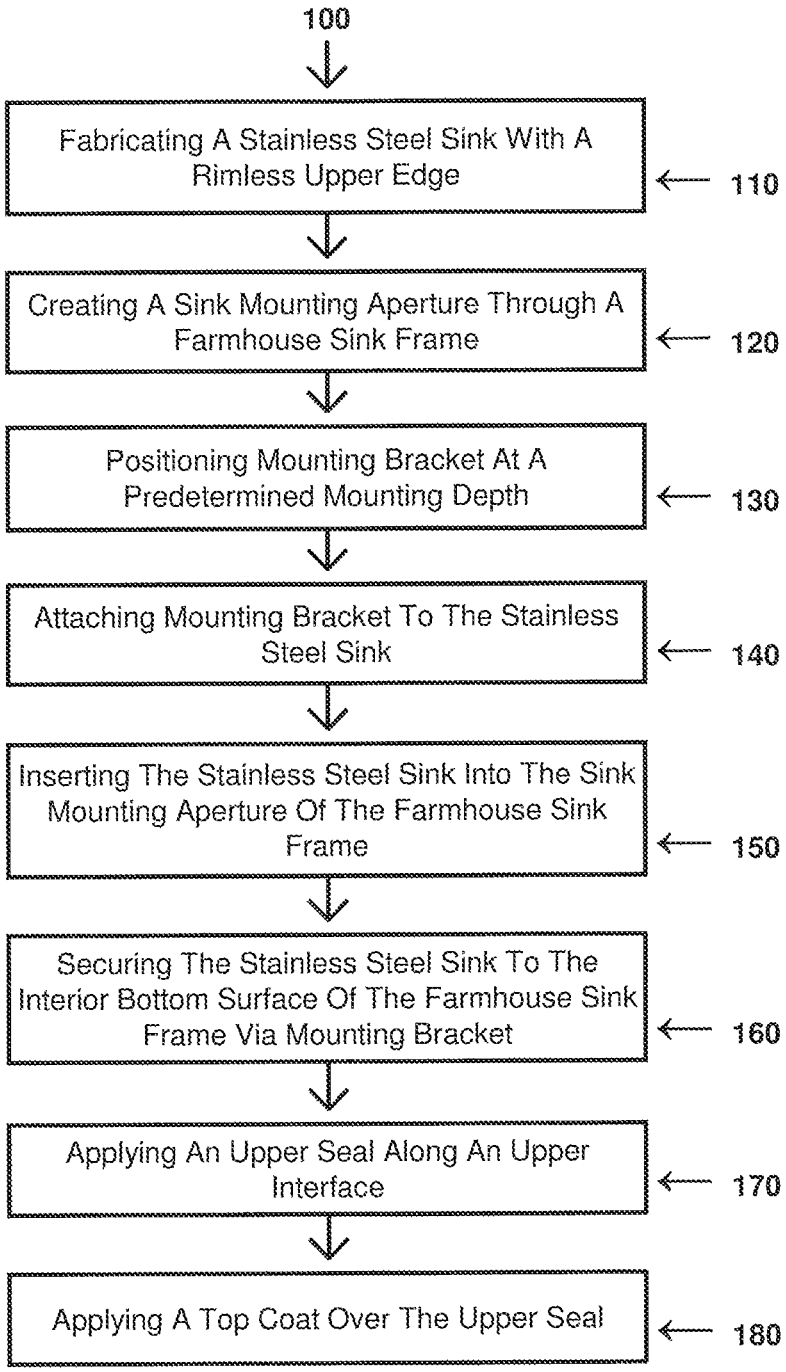
FIG. 9 is a block diagram illustrative of one method for the installation of a farmhouse sink system with a rimless stainless steel sink in accordance with the present invention.

As may be seen from FIG. 9, the present method 100 also includes inserting the rimless upper edge of the stainless steel sink through the interior bottom surface of the farmhouse sink frame and into the sink mounting aperture 150. In accordance with one further embodiment of the invention, the present method 100 includes securing the stainless steel sink to the interior bottom surface of the farmhouse sink frame via at least one mounting bracket 160.

With reference once again to the illustrative embodiment of FIG. 9, the present method 100 further comprises applying an upper seal along an upper interface 170, wherein the upper seal is disposed between the rimless upper edge of the stainless steel sink and the inner periphery of the sink mounting aperture through the farmhouse sink frame. The upper seal prevents water, moisture, bacteria, and debris from entering between the rimless upper edge of the stainless steel sink and the farmhouse sink frame.

In at least one further embodiment, the present method 100 comprises applying a top coat over the upper seal 180, so as to camouflage the presence of the upper seal. The top coat, in at least one embodiment, comprises a color matching acrylic, epoxy or polyester resin selected to simulate the color of the top surface of the farmhouse sink frame.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A farmhouse sink system with a rimless stainless steel sink comprising:

a cabinet assembly;

a countertop having an upper surface and a lower surface, said countertop mounted onto said cabinet assembly;

a sink access opening disposed through a portion of said countertop;

a farmhouse sink frame sized and configured for mounting between said cabinet assembly and said countertop;

said farmhouse sink frame having a top surface and an interior bottom surface;

a sink mounting aperture formed through said farmhouse sink frame between said top surface and said interior bottom surface;

a stainless steel sink comprising a sidewall and at least one bowl;

a rimless upper edge along and around said sidewall of said stainless steel sink, said rimless upper edge defining an outer periphery of said stainless steel sink;

said rimless upper edge of said stainless steel sink disposed adjacent and coplanar with said top surface of said farmhouse sink frame when mounting said stainless steel sink into said sink mounting aperture of said farmhouse sink frame through said interior bottom surface;

a mounting assembly comprising at least one mounting bracket attached to a portion of said stainless steel sink, said at least one mounting bracket configured for attaching said stainless steel sink to a portion of said farmhouse sink frame;

an upper interface formed between said rimless upper edge of said stainless steel sink and said top surface of said farmhouse sink frame;

an upper seal disposed in said upper interface between said rimless upper edge of said stainless steel sink and said top surface of said farmhouse sink frame; and said farmhouse sink frame mounted between said cabinet assembly and said countertop such that said stainless steel sink is operatively disposed adjacent and below said sink access opening.

2. The system as recited in claim 1 wherein said upper seal forms a moisture resistant barrier along said upper interface.

3. The system as recited in claim 2 wherein said upper seal prevents water, bacteria, or debris from entering between said rimless upper edge of said stainless steel sink and said farmhouse sink frame.

4. The system as recited in claim 2 wherein said upper seal comprises an adhesive.

5. The system as recited in claim 4 further comprising a top coat, said top coat selected to correspond to a color of said top surface of said solid countertop in order to camouflage its presence.

6. The system as recited in claim 1 wherein said at least one mounting bracket is secured to said interior bottom surface of said farmhouse sink frame.

7. The system as recited in claim 6 further comprising an adhesive, interconnecting said at least one mounting bracket to said interior bottom surface of said farmhouse sink frame.

8. The system as recited in claim 1 wherein said stainless steel sink comprises a plurality of bowls separated by a recessed divider.

9. The system as recited in claim 1 wherein said mounting assembly comprising a plurality of mounting brackets interconnected to a portion of said stainless steel sink.

10. A method for the installation of a farmhouse sink system with a rimless stainless steel sink, the method comprising:

fabricating the stainless steel sink with a rimless upper edge, said rimless upper edge defining an outer periphery of said stainless steel sink;

creating a sink mounting aperture through the farmhouse sink frame between a top surface and an interior bottom surface, wherein the sink mounting aperture comprises an inner periphery dimensioned for receiving the outer periphery of the rimless upper edge of the stainless steel sink therein;

positioning at least one mounting bracket at a predetermined mounting depth below the rimless upper edge of the stainless steel sink;

attaching the at least one mounting bracket to the stainless steel sink;

inserting the rimless upper edge of the stainless steel sink through the interior bottom surface of the farmhouse sink frame and into the sink mounting aperture, such that the rimless upper edge of the stainless steel sink is adjacent and coplanar with the top surface of the farmhouse sink frame;

securing the stainless steel sink to the interior bottom surface of the farmhouse sink frame via at least one mounting bracket; and applying an upper seal along an upper interface between the rimless upper edge of the stainless steel sink and the inner periphery of the sink mounting aperture through the farmhouse sink frame, the upper seal prevents water, moisture, bacteria, and debris from entering between the rimless upper edge of the stainless steel sink and the farmhouse sink frame.

11. The method as recited in claim 10 wherein the mounting assembly comprises a plurality of mounting brackets.

12. The method as recited in claim 10 wherein the upper seal comprises an adhesive.

13. The method as recited in claim 12 further comprising applying a top coat over the upper seal.

14. The method as recited in claim 10 wherein the upper interface between the rimless upper edge of the stainless steel sink and the inner periphery of the solid countertop measures less than one millimeter.

15. A farmhouse sink system with a rimless stainless steel sink comprising:

a cabinet assembly;

a countertop having an upper surface and a lower surface, said countertop mounted onto said cabinet assembly;

a sink access opening disposed through a portion of said countertop;

a farmhouse sink frame sized and configured for mounting between said cabinet assembly and said countertop;

said farmhouse sink frame having a top surface and an interior bottom surface;

a sink mounting aperture formed through said farmhouse sink frame between said top surface and said interior bottom surface;

a stainless steel sink comprising a sidewall and at least one bowl;

a rimless upper edge along and around said sidewall of said stainless steel sink, said rimless upper edge defining an outer periphery of said stainless steel sink;

said rimless upper edge of said stainless steel sink disposed adjacent and coplanar with said top surface of said farmhouse sink frame when mounting said stainless steel sink into said sink mounting aperture of said farmhouse sink frame through said interior bottom surface;

a mounting assembly comprising at least one continuous mounting bracket attached to a portion of said stainless steel sink, said at least one continuous mounting bracket structured and configured to attach said stainless steel sink to a portion of said farmhouse sink frame;

an upper interface formed between said rimless upper edge of said stainless steel sink and said top surface of said farmhouse sink frame;

an upper seal disposed in said upper interface between said rimless upper edge of said stainless steel sink and said top surface of said farmhouse sink frame; and said farmhouse sink frame mounted between said cabinet assembly and said countertop such that said stainless steel sink is operatively disposed adjacent and below said sink access opening.

16. The system as recited in claim 15 wherein said at least one continuous mounting bracket encircles said sidewall of said stainless steel sink.

17. The system as recited in claim 15 wherein said at least one continuous mounting bracket is positioned at a predetermined mounting depth below said rimless upper edge of said stainless steel sink.

18. The system as recited in claim 15 wherein said upper seal forms a moisture resistant barrier along said upper interface.

19. The system as recited in claim 18 wherein said upper seal prevents water, bacteria, or debris from entering between said rimless upper edge of said stainless steel sink and said farmhouse sink frame.

20. The system as recited in claim 19 wherein said upper seal comprises an adhesive.

* * * * *